United States Patent [19]

Ferraris

[11] Patent Number: 4,874,001

[45] Date of Patent: Oct. 17, 1989

[54] MANICURIST'S BIT

[75] Inventor: Lori Ferraris, Los Angeles, Calif.

[73] Assignee: Konsepts Beauty Supply, Inc., Los Angeles, Calif.

[21] Appl. No.: 115,703

[22] Filed: Nov. 2, 1987

[51] Int. Cl.[4] ..... A45D 29/05

[52] U.S. Cl. ..... 132/75.8; 132/73; 144/240; 407/56; 407/61

[58] Field of Search ..... 132/73, 76.4, 73.5, 132/73.6, 75.3, 75.4, 75.5, 75.6, 75.8; 433/166; 30/347, 388; 407/53, 56, 61, 51; 29/78; 144/218, 240

[56] References Cited

U.S. PATENT DOCUMENTS

| | | | |
|---|---|---|---|
| 706,013 | 8/1902 | Boyce | 433/166 |
| 1,519,876 | 12/1924 | Phelps | 407/61 |
| 1,812,488 | 6/1931 | Krausz | 132/73.5 |
| 2,265,643 | 12/1941 | Heath | 407/51 |
| 2,822,838 | 2/1958 | Kull | 407/61 |
| 3,798,723 | 3/1974 | Czopor | 407/53 |
| 3,831,236 | 8/1974 | Coburn et al. | 407/53 |
| 3,872,594 | 3/1975 | Gerteisen | 433/166 |
| 3,911,545 | 10/1975 | Ohashi et al. | 407/51 |
| 4,109,690 | 8/1978 | Berg | 144/218 |

OTHER PUBLICATIONS

"A Bur!", Journal of American Dental Association, vol. 77, No. 2, Aug. 1968, p. 435.

*Primary Examiner*—John J. Wilson
*Assistant Examiner*—Adriene J. Lepiane
*Attorney, Agent, or Firm*—Spensley Horn Jubas & Lubitz

[57] ABSTRACT

A manicurist's bit for shaving away layers of an artificial fingernail. The bit comprises an elongated body portion having a right circular cross section, and has a plurality of angled knurls extending along the width of the body portion. In a preferred embodiment, one end of the body portion is concave. In operation, the bit is given a circular motion in the direction of the angle of the knurls, and is thereafter applied to the surface of the nail to be shaped. The bit shaves away portions of the fingernail, and can be used to shape the nail in the area near the cuticle, and can be used to shape the underside of the nail close to the finger tip.

7 Claims, 1 Drawing Sheet

MANICURIST'S BIT

BACKGROUND OF THE INVENTION

1. Field of the Invention

The present invention relates generally to a manicurist's bit for shaping acrylic artificial fingernails and, more specifically, to a shaping bit which shapes acrylic nails by shaving away layers of the acrylic fingernail.

2. Description of the Related Art

When applying artificial acrylic nails the acrylic material is applied to the subject's original nail in great thicknesses, generally about one-quarter (¼) inch. Once the acrylic material has set and is firmly adhered to the natural nail it must be shaped to give the appearance of a natural nail. Most often this entails removing a significant portion of the acrylic thickness with a shaping bit.

Presently two types of shaping tools are generally used by manicurists to shape acrylic artificial nails. These are the diamond bit and the emery board.

The diamond bit comprises diamond dust particles or substantially equally hard particles disposed on the circumferential surface of a bit. In operation, this bit is given a high rotational speed and is used to grind away the surface of an acrylic nail to shape and form the nail to a desired thickness. This grinding action requires that the manicurist move the rotating bit back and forth along the surface of the nail while applying pressure. This back and forth movement of the rotating bit has two significant disadvantages: (1) an extreme temperature may be developed on the surface of the nail which radiates to the subject, thus causing a burning sensation; (2) the constant back and forth grinding typically develops acrylic dust particles which can be inhaled by the manicurist and the subject, and thus creating a significant health hazard.

Emery boards, which have the conventional emery sand-like material adhered to the surface area of a thin portion of cardboard, are rubbed vigorously across the surface of the acrylic nail to grind away excess acrylic. This vigorous rubbing, which also has the disadvantages of creating frictional heat and creating acrylic dust, is awkward to use and is often ineffective when attempting to shape the underside portion of the acrylic nail.

SUMMARY OF THE INVENTION

It is an object of the present invention to provide a manicurist bit for shaving away layers of an artificial acrylic nail.

It is another object of the present invention to provide a manicurist bit which shapes the acrylic nail surface without generating significant amounts of acrylic dust.

It is a further object of the present invention to provide a manicurist bit for shaping artificial acrylic nails without generating a significant frictional heat build up.

It is a still further object of the present invention to provide a manicurist bit for shaping the underside of an acrylic nail close to the finger without causing discomfort to the subject.

These and other objects of the present invention are achieved by a manicurist bit for shaving artificial acrylic fingernails comprising an elongated circular body portion having a plurality of angled knurls protruding therefrom. The term "knurls", as used herein, is intended to refer generally to protrusions extending from or near the surface of the body portion. The knurls are preferably angled away from a line which is normal to the surface of the body portion and have a flat planar surface area. In a preferred embodiment, the knurls are angled in one direction to provide for unidirectional operation of the bit. The bit generally includes a shaft portion for insertion into a manicurist tool or similar device for imparting a rotational motion to the bit. In an alternative embodiment one extreme end of the bit has a concave surface area.

DETAILED DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

For ease of discussion the present inventive bit is described with reference to its use to shape artificial acrylic fingernails. However, it is recognized that the bit may additionally be used to shape and form other natural and artificial surfaces such as toenails, animal claws and human and animal teeth, which may be formed from other acrylic and nonacrylic materials.

Figure 1:
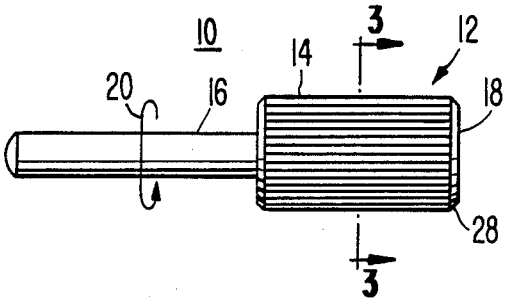
FIG. 1 shows one embodiment of the present invention.

Referring now to the drawings wherein like reference numerals depict like items throughout, FIG. 1 shows one embodiment $E_1$ of the present manicurist bit. As shown, the bit 10 comprises an elongated body portion 12 of circular cross section having a plurality of angled knurls 14 protruding therefrom and a shaft portion 16 extending from one end of the body portion. The shaft 16 provides for easy insertion of the bit 10 into a manicurist tool (not shown). Generally such tools are small hand held devices which may be battery powered or powered from a conventional house current and which impart a rotating motion to the bit 10 in the direction of arrow 20. In the embodiment shown in FIG. 1, the bit 10 has a flat end surface 18. Also, as shown, the knurls 14 may terminate before reaching the extreme ends of the body portion 12 of the bit 10. At the point where the knurls end, the body portion 12 has a termination angle 28 of approximately 45° towards the bit end 18.

In operation, the manicurist tool imparts a circular motion to the bit 10 which is thereafter applied to the surface of the acrylic nail. Due to the present inventive design of the knurls 14, the bit 10, when applied to the acrylic nail surface, shaves away layers of the acrylic nail. This shaving shapes the nail faster than can be achieved with prior art devices which slowly grind away the surface of the nail. By shaving the acrylic nail rather than grinding, the present invention greatly reduces the generation of acrylic dust which, when inhaled by the manicurist or subject, may create a significant health problem. During use, the beveled leading edge 24 (FIG. 3) of the knurls 14 allows the manicurist to smooth the base of the acrylic nail near the cuticle without cutting or damaging the healthy cuticle, thus providing a safe means for accurately sculpting the acrylic nail. Because the present invention shaves the acrylic surface quickly, little if any frictional heat is generated. This is a significant advantage, since grinding and excessive heat build-up may damage the healthy human nail lying beneath the acrylic surface and may hinder healthy nail growth.

The present invention can be used to shave the backside of the nail to create a thinner, neater and more natural looking nail.

Figure 2:
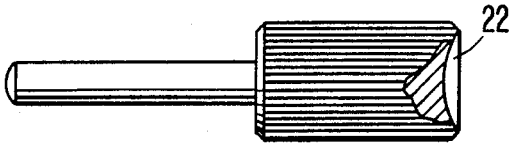
FIG. 2 shows an alternative embodiment of the present invention wherein one extreme end is provided with a concave surface area.

FIG. 2 shows an alternative embodiment $E_2$ of the present inventive bit. In this embodiment the end surface 18 is provided with a concavity 22 instead of a flat end 18 as shown with embodiment $E_1$. With this embodiment, the underside of an acrylic nail can be shaved closer to the finger tip without any noticeable heat build-up which might cause the subject discomfort. The concavity 22 may vary in depth, with a preferred depth being equal to approximately 0.05 inches.

Figure 3:
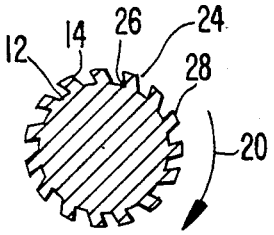
FIG. 3 shows a cross-sectional view of the FIG. 1 embodiment along section lines 3—3.

As shown in FIG. 3, the knurls of the preferred embodiment have an angled first edge 24 and a second edge 26 which is angled away from said first edge 24. Also, the preferred knurls have a planar surface area 28. However, in alternative embodiments, the second edge may be non-angled, i.e., extend along a line normal to the surface or may be angled toward the leading edge, thus providing for bidirectional operation. Also, the knurls may be bowed, i.e., extend from the body surface with a first edge curvature, second edge curvature or with both edges curved.

A preferred range of dimensions for the inventive bit has been experimentally determined and is listed in Table I. The headings $E_1$ and $E_2$ in Table I designate the preferred dimensions for the embodiments $E_1$ and $E_2$ discussed above. The $E_3$ heading shown in Table I illustrates the dimensions for an unillustrated smaller diameter version of the bit $E_2$.

TABLE I

| | Example Dimensions | | | | | | | | |
|---|---|---|---|---|---|---|---|---|---|
| | $E_1$ | | | $E_2$ | | | $E_3$ | | |
| Body Diameter | .24 | .25 | .26 | .24 | .25 | .26 | .18 | .19 | .20 |
| Depth of Knurls | .003 | .008 | .015 | .003 | .008 | .015 | .003 | .008 | .015 |
| Spacing of Knurls | .006 | .0075 | .01 | .006 | .0075 | .01 | .006 | .0075 | .01 |
| Number of Knurls | | 31 | | | 31 | | | 23 | |
| Angle of Knurls | 1° | 10° | 80° | 1° | 10° | 80° | 1° | 10° | 80° |
| Depth of Concavity | | — | | .045 | .05 | .055 | .035 | .04 | .045 |

An $E_1$ embodiment bit designed in accordance with preferred range of dimensions would have on the order of 31 knurls. This would result in a bit having approximately 39.24 knurls/inch. For the $E_3$ embodiment utilizing the preferred dimension there would be approximately 23 knurls, or approximately 38.33 knurls/inch.

The preferred embodiment bit is designed for unidirectional operation, i.e., the bit shaves when rotating with the beveling in the direction of arrow 20. However, bidirectionally operating may alternatively be utilized and are intended to be included within the scope of the present invention.

The present disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A bit for shaping artificial surfaces, comprising:

a substantially cylindrically-shaped body portion;

a plurality of knurls, each knurl having a leading edge and a trailing edge, said leading edge and trailing edge of each knurl protruding from said body portion, said leading edge and trailing edge being angled with respect to the normal line of the body portion at the point of protrusion and being substantially parallel, and each of said knurls having a planar surface area connecting said leading and trailing edges;

wherein one end of said body portion has a concave surface area.

2. The bit of claim 1, wherein said body portion has termination angles.

3. The bit claimed in claim 1, wherein the entire length of each of said knurls is arranged outside of said concave surface area.

4. A bit for shaping artificial surfaces, comprising:

a substantially cylindrically-shaped body portion;

a plurality of knurls, each knurl having a leading edge and a trailing edge, said leading edge and trailing edge of each knurl protruding from said body portion, said leading edge and trailing edge being angled with respect to the normal line of the body portion at the point of protrusion and being substantially parallel, and each of said knurls having a planar surface area connecting said leading and trailing edges;

wherein said body portion has a diameter in the range of 0.18 to 0.20 inches, said knurls having a height in the range of 0.003 to 0.015 inches, said knurls having a spacing between one another in the range of 0.006 to 0.01 inches, said knurls being angled in the range of 1° to 20°;

wherein said body portion has a concave end, said concavity being in the range of 0.035 to 0.045 inches.

5. A bit for shaping artificial surfaces, comprising:

a substantially cylindrically-shaped body portion;

a plurality of knurls, each knurl having a leading edge and a trailing edge, said leading edge and trailing edge of each knurl protruding from said body portion, said leading edge and trailing edge being angled with respect to the normal line of the body portion at the point of protrusion and being substantially parallel, and each of said knurls having a planar surface area connecting said leading and trailing edges;

said body portion having a diameter in the range of 0.24 to 0.26 inches;

said knurls having a height in the range of 0.003 to 0.015 inches, said knurls having a spacing between one another in the range of 0.006 to 0.01 inches, said knurls being angled in the range of 1° to 20°;

wherein one end of said body portion is concave.

6. The bit of claim 5, wherein said concavity is in the range of 0.045 to 0.055 inches.

7. A method for shaping an artificial fingernail by shaving off portions of the artificial fingernail, comprising the steps of:

selecting a bit having a body portion including a plurality of knurls having substantially parallel leading edges and trailing edges protruding from said body portion at an angle with respect to the normal of the body portion at the point of protrusion;

imparting a circular rotating motion to said bit; and applying said bit to said artificial fingernail, whereby portions of said artificial fingernail are shaved off and removed.

* * * * *